US008807877B1

(12) United States Patent
Fox

(10) Patent No.: US 8,807,877 B1
(45) **Date of Patent: *Aug. 19, 2014**

(54) TENSIONABLE SPIRAL BOLT WITH RESIN NUT AND RELATED METHODS

(75) Inventor: William G. Fox, White Plains, KY (US)

(73) Assignee: Rhino Technologies LLC, Lexington, KY (US)

( * ) Notice: Subject to any disclaimer, the term of this patent is extended or adjusted under 35 U.S.C. 154(b) by 460 days.

This patent is subject to a terminal disclaimer.

(21) Appl. No.: 12/563,542

(22) Filed: Sep. 21, 2009

Related U.S. Application Data

(60) Provisional application No. 61/104,450, filed on Oct. 10, 2008, provisional application No. 61/098,358, filed on Sep. 19, 2008.

(51) Int. Cl.
*E21D 20/00* (2006.01)

(52) U.S. Cl.
USPC ..... 405/259.5; 405/259.1; 405/302.1

(58) Field of Classification Search
USPC ..... 405/259.1, 259.5, 259.6, 302.1; 411/902, 903, 930
See application file for complete search history.

(56) References Cited

U.S. PATENT DOCUMENTS 1,099,668 A * 6/1914 Rosenberg ..... 411/42
3,407,251 A * 10/1968 Elliott et al. ..... 264/135
3,485,132 A * 12/1969 Hanny et al. ..... 411/548
3,695,045 A * 10/1972 Williams ..... 405/259.5
4,062,229 A 12/1977 Godfrey et al.
4,100,748 A 7/1978 Hansen
4,132,080 A 1/1979 Hansen
4,295,761 A 10/1981 Hansen
4,305,687 A 12/1981 Parker
4,307,979 A 12/1981 Killmeyer
4,325,657 A 4/1982 Elders
4,386,877 A 6/1983 McDowell, Jr.
4,564,315 A 1/1986 Rozanc
4,618,290 A 10/1986 Hansen
4,630,971 A * 12/1986 Herbst et al. ..... 405/259.5
4,633,732 A * 1/1987 Nishikawa et al. ..... 74/493
4,642,964 A 2/1987 Kellison
4,662,795 A 5/1987 Clark et al.
4,746,248 A 5/1988 Lillis et al.
4,781,505 A * 11/1988 Watanabe ..... 411/301
4,915,542 A * 4/1990 Fernando ..... 405/150.1
5,013,192 A 5/1991 Scott
5,234,291 A 8/1993 Swemmer
5,253,964 A 10/1993 Swemmer
5,259,703 A * 11/1993 Gillespie ..... 405/259.6
5,273,377 A 12/1993 Taylor
5,282,698 A 2/1994 Wright et al.
5,387,060 A 2/1995 Locotos
5,544,981 A 8/1996 Nishida et al.
5,562,377 A * 10/1996 Giannuzzi et al. ..... 411/82

(Continued)

*Primary Examiner* — Tara M. Pinnock
(74) *Attorney, Agent, or Firm* — King & Schickli, PLLC

(57) ABSTRACT

In one aspect of the invention, an apparatus and related methods for installation in a borehole formed in a face of a mine passage comprises an elongated bolt including a spiral portion coated with a lubricity agent for positioning in the borehole; preferably, a fixing agent as well; and most preferably, a colored fixing agent. A hardened, stationary resin nut formed in only part of the borehole, preferably spaced from the distal end thereof, my receive the spiral portion of the bolt. Consequently, rotation of the spiral portion within the hardened resin nut serves to move the bolt within the borehole, such as for purposes of tensioning.

27 Claims, 7 Drawing Sheets

(56) References Cited

U.S. PATENT DOCUMENTS

| | | | | |
|---|---|---|---|---|
| 5,688,077 | A | 11/1997 | Kynoch | |
| 5,827,014 | A | 10/1998 | Swemmer | |
| 5,895,186 | A * | 4/1999 | Giannuzzi et al. | 411/82 |
| 6,698,980 | B2 * | 3/2004 | Mongrain | 405/259.5 |
| 6,874,975 | B2 | 4/2005 | Hilfiker et al. | |
| 7,481,603 | B1 * | 1/2009 | Fox | 405/259.5 |
| 7,758,284 | B2 * | 7/2010 | Fox | 405/259.5 |
| 8,337,120 | B2 * | 12/2012 | Li | 405/259.5 |
| 2004/0091323 | A1 * | 5/2004 | Simmons et al. | 405/259.1 |
| 2004/0109729 | A1 | 6/2004 | Hilfiker et al. | |
| 2010/0021245 | A1 * | 1/2010 | Li | 405/259.5 |

* cited by examiner

Fig. 5
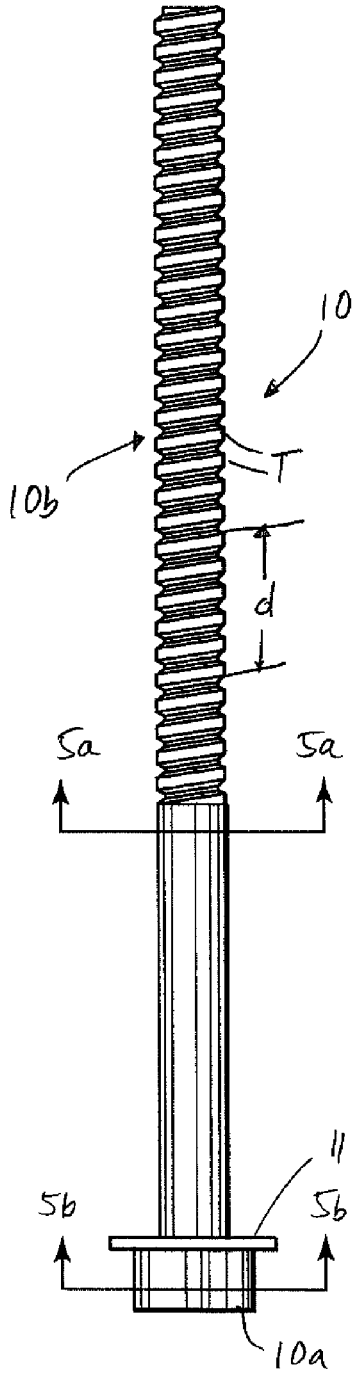
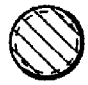
Fig. 5a
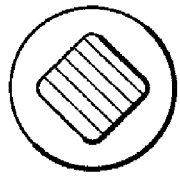
Fig. 5b

TENSIONABLE SPIRAL BOLT WITH RESIN NUT AND RELATED METHODS

This application claims the benefit of U.S. Provisional Patent Application Ser. Nos. 61/104,450 and 61/098,358, the disclosures of which are incorporated herein by reference.

TECHNICAL FIELD

The present inventions relate generally to providing support for a face of a passage in a geological structure and, more particularly, to a tensionable spiral bolt associated with a resin nut partially occupying a borehole and related methods.

BACKGROUND OF THE INVENTION

In recent decades, a number of proposals for supporting the face of a passage in a geological structure, such as the roof in an underground mine, have been made. The typical arrangement employs an anchor, such as an elongated roof "bolt," that extends into a borehole formed in the face. Federal regulations pertaining to underground mine safety require the placement of these bolts at frequent intervals throughout the mine passage.

Consequently, ease of manufacture and use are critical factors in terms of reducing the overall installation cost to the mine owner (which directly correlates to the profitability of the mining operation).

Accordingly, a need exists for an improved bolting apparatus that addresses the requirements of cost efficiency and effectiveness. Specifically, the bolt should be easy and inexpensive to manufacture and install. The bolt may also be tensionable to compress and provide secure, reliable support for the adjacent strata once installed.

SUMMARY OF THE INVENTION

One aspect of the disclosure is an apparatus for installation in a borehole formed in a face of a mine passage. The apparatus comprises an elongated bolt including a spiral portion for positioning in the borehole, said spiral portion at least partially coated with a lubricity agent. A stationary, hardened resin nut may be formed in a portion of the borehole for surrounding at least part of the spiral portion of the bolt, whereby rotation of the spiral portion within the resin nut serves to move the bolt.

A fixing agent may be applied to the spiral portion. Preferably, the lubricity agent is mixed with the fixing agent. Most preferably, the ratio of the fixing agent to the lubricity agent is about 2:1.

The spiral portion may comprise a threaded portion of the bolt, which may be square or round in cross-section. Most preferably, the spiral portion includes a generally circular cross-section with approximately 4-5 threads per inch in the longitudinal direction.

In accordance with another aspect of the disclosure, a method of providing a bolt including a spiral portion for insertion in a borehole formed in a face of a mine passage. The method comprises providing a lubricity agent on at least part of the spiral portion of the bolt.

The method may further include the step of forming a stationary, hardened resin nut adjacent at least the spiral portion of the bolt, and rotating the spiral portion relative to the resin nut. In turn, the forming step may comprise providing uncured resin within the borehole adjacent the spiral portion of the bolt; rotating the bolt in a first direction to substantially maintain the resin adjacent the spiral portion; and allowing the resin to substantially cure and form the hardened resin nut. The rotating step may comprise rotating the spiral portion in a second direction opposite the first direction upon the substantial curing of the resin. The method may further include providing a fixing agent on at least part of the spiral portion of the bolt.

Yet a further aspect of the disclosure is a method of installing an elongated bolt having a head end and a threaded or spiral portion in a face of a mine passage having a borehole. The method comprises providing at least part of the spiral portion of the bolt with a lubricity agent; and inserting the bolt at least partially within the borehole. The method may further include the steps of: (1) rotating the bolt in a first direction and at least partially within an uncured resin in the borehole; (2) allowing the resin to substantially cure and form a nut; and (3) rotating the bolt such that the bolt moves through the resin nut with the head end moving closer to the opening of the borehole.

In the case where the head end of the bolt is initially spaced from the open end of the borehole, the step of rotating the bolt advances the head end of the bolt toward the open end of the borehole. The step rotating the bolt is preferably accomplished such that the bolt moves through the resin nut with the head end moving closer to the opening of the borehole comprises rotating the bolt in a second direction opposite the first direction, or alternatively in the first direction. The method may further include providing a fixing agent on at least part of the spiral portion of the bolt.

BRIEF DESCRIPTION OF THE DRAWINGS

FIG. 5 shows an alternate spiral bolt;

FIGS. 5*a* and 5*b* are cross-sections taken along lines 5*a*-5*a* and 5*b*-5*b* of FIG. 5, respectively.

DETAILED DESCRIPTION OF THE INVENTION

Figure 1:
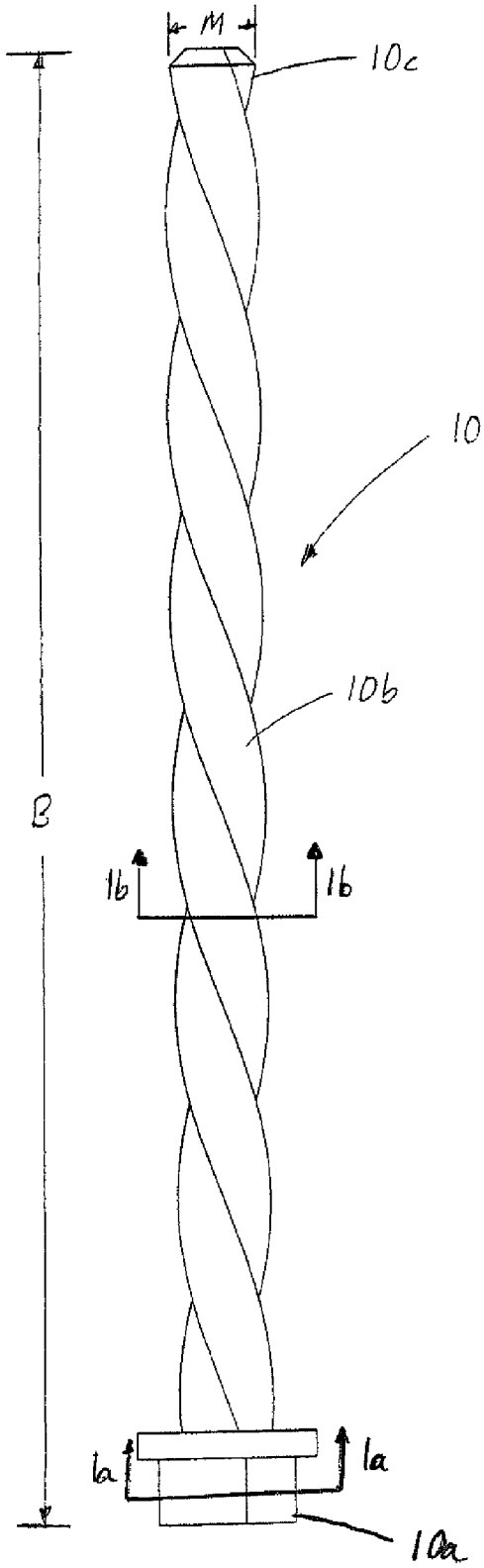
FIG. 1 is an elevational view, not to scale, of one possible embodiment of a roof bolt with a spiral portion.

Reference is now made to FIG. 1, which illustrates one embodiment of a bolt 10 for installation in a face F of a mine passage, such as the roof (see FIG. 2) having a borehole H formed vertically therein, usually by a drill steel or bit associated with a rock drill forming part of a drill head on a bolting machine. Although the bolt 10 and related installation method are described as being used to reinforce and sustain a mine roof, it should be understood that the present invention may be applied to support any one of the other faces of the passage (e.g., a rib) or a different type of geological structure, without limitation.

Figure 1A:
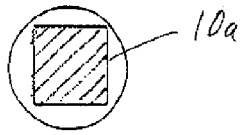
FIGS. 1*a* and 1*b* are cross-sections taken along lines 1*a*-1*a* and 1*b*-1*b* of FIG. 1, respectively.

As illustrated, the bolt 10 is preferably an elongated, one-piece structure comprising a fixed head end 10*a*, an elongated body or shaft 10*b*, and a tail end 10*c*. As perhaps best understood with combined reference to FIGS. 1 and 1*a*, the head end 10*a* is adapted for being engaged by a wrench, chuck of a drill head (see FIG. 2), or like device or means for rotating the bolt 10 during installation. Despite being shown as having a portion with a generally square cross-section (FIG. 1*a*), it should be appreciated that the head end 10*a* of the bolt 10 may take on other cross-sectional shapes (e.g., hexagonal) without impacting the practice of the present invention in any meaningful way. An annular flange 11 is also provided adjacent the head end 10*a* to provide a bearing surface for the means for rotating on one side and the face or intervening structure (such as plate P; see FIG. 2) on the other.

Figure 1B:
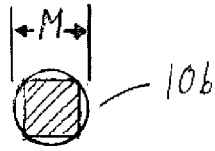

In one embodiment, the shaft 10*b* of the bolt 10 is generally square in cross-section (see FIG. 1*b*), but is "twisted" or threaded along its length to form a spiral or helix. In the illustrated embodiment of FIG. 1, the spiral extends along the entire length of the shaft 10*b*, and is left-handed in nature (but could be the opposite as well). Although the number of spirals (twists or threads) per linear unit (inch or foot), or pitch, of the bolt 10 is not essential to practice of the invention, the arrangement is preferably coarse in nature (equal to or greater than about four threads per inch, up to about seven per foot). Moreover, the arrangement is preferably such that the maximum width (e.g., diameter) of the shaft 10*b* of the bolt 10 is substantially the same or identical, at least in the portion that will be inserted into and eventually surrounded by resin. Most preferably, the major diameter of the spiral (e.g., thread T) is constant.

As a specific example, and with reference to FIGS. 5, 5*a*, and 5*b*, the shaft 10*b* of the bolt 10 is shown as being generally round in cross-section, and includes a spiral portion formed by threads T. For example, each inch of the spiral shaft 10*b* preferably includes between about 4 to 5 complete (e.g., 360°) threads. Most preferably, each complete thread occupies about 0.22 inches of distance in the longitudinal direction, or length, which corresponds to about 4.5 complete twists per linear inch (see reference character d representing pitch). Of course, a corresponding thread is formed in the resin nut once it is formed in the borehole and the threaded spiral bolt 10 installed in the manner described in the foregoing passage.

While it is easier in terms of manufacturing to provide a consistent spiral continuously along the entire length of the shaft 10*b* (such as by simply twisting square bar stock or cutting threads in round bar stock), it will be understood upon reviewing the description that follows that the spiral may be provided along only a portion of the shaft 10*b*. Preferably, in such case, the spiral is along the tail end 10*c*, or otherwise away from the head end 10*a*.

Figure 2:
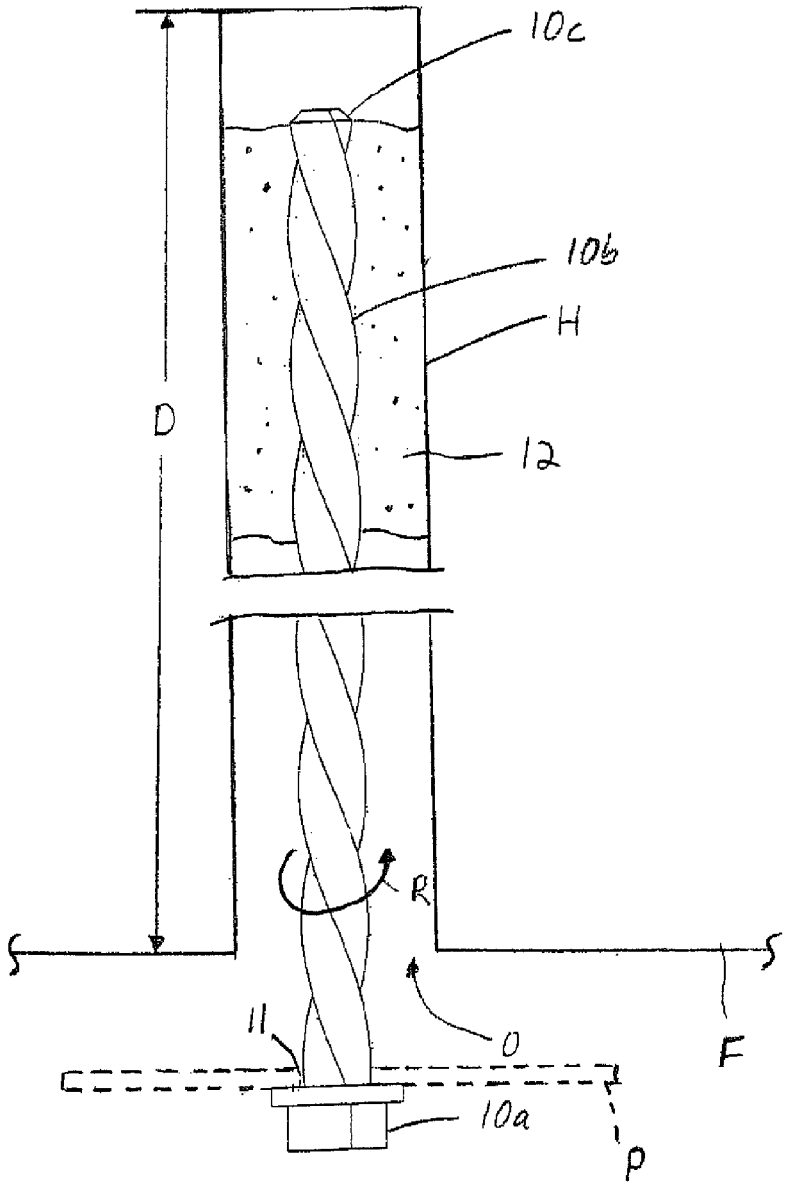
FIGS. 2-4 are schematic diagrams showing the manner in which the spiral bolt of FIG. 1 may be tensioned using a resin nut formed in the borehole.
Figure 3:
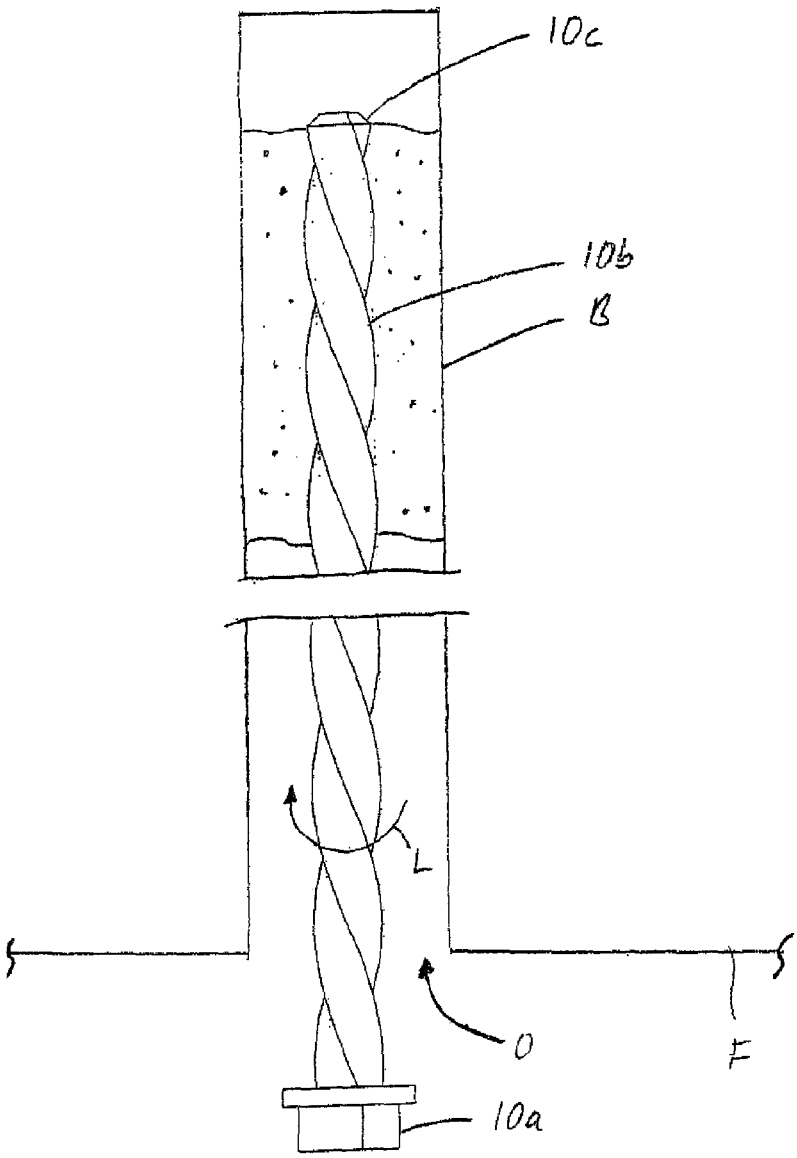

Reference is now made to FIG. 2, which although not drawn to scale, illustrates schematically the manner in which the bolt 10 of FIG. 1 is installed in the borehole H. Specifically, the tail end 10*c* of the bolt 10 is inserted through the opening O of the borehole H, which is preferably formed having a diameter close to the width M of the spiral shaft 10*b* (e.g., ¾" for a 1 inch diameter borehole). The borehole H also preferably has a depth D greater than at least the spiral shaft 10*b*, and preferably greater than the length of the entire bolt 10 (e.g., dimension B in FIG. 1) by at least one inch.

Using a lift boom associated with a bolting machine or like structure, the bolt 10 is advanced into the borehole H such that the head end 10*a* remains spaced from the adjacent face of the roof a distance equal to or slightly less than the excess depth D of the borehole H (e.g., about two inches). As shown in phantom in FIG. 2, a plate P is typically associated with the head end 10*a* of the bolt 10, and would thus also be spaced from the face F. However, once the bolt 10 is tensioned in the manner described below, this plate P engages the face F and compresses the associated strata (see FIG. 4).

Once the bolt 10 is partially inserted, uncured resin (also sometimes referred to as "grout") is provided adjacent at least a portion of the spiral shaft 10*b* in the associated annulus (which is shown in FIG. 2 as being greatly oversized for purposes of illustration, but is normally only about ⅛"-¼" on either side). Most preferably, the uncured resin occupies the annulus adjacent the tail end 10*c* of the bolt 10, and in the upper portion of the borehole H. Although the uncured resin may be provided from a remote source, such as by way of injection, it is most preferably supplied in the form of a frangible cartridge (not shown), or resin "sausage" in the vernacular. Typically, this type of cartridge is pre-installed in the borehole H and ruptured during insertion of the bolt 10, thus causing a quick-curing resin to occupy the surrounding borehole H. This "grout" usually comprises two materials (e.g., polyester resin and a catalyst paste) that make contact and react only upon the rupturing of the cartridge. Upon being thoroughly mixed, such as by the rotation of the bolt 10 within the borehole H, the resin then quickly and completely hardens. The hardened resin or grout thus serves to hold the bolt 10 securely within the borehole H.

In accordance with another aspect of the invention, the bolt 10 with the spiral shaft 10*b* is rotated to effect the desired mixing and/or hardening, such as by using any conventional type of bolting machine. In the illustrated embodiment in which the spiral is left-handed in nature, the rotation is in the opposite, or right-handed, direction (see action arrow R in FIG. 2). Preferably, this rotation is done without simultaneously advancing the bolt 10 within the borehole H any significant amount, such that it remains spaced from the opening O of the borehole H.

As should be appreciated, this rotation in combination with the spiral shaft 10*b* serves to create a "pumping" action that substantially holds the uncured resin in place, and may possibly advance or "push" this resin deeper within the borehole H. In other words, the spiral shaft 10*b* of the bolt 10 may essentially function as an auger or screw with flights that maintain the resin at a particular location within the upper end of the borehole H. In any case, the rotation of the spiral shaft 10*b* preferably is such that it prevents the uncured resin from advancing toward the opening O of the borehole H to any significant degree. As a result of this pumping action, once the resin sets or cures (normally, after a period of rest post-mixing), it surrounds only a portion of the spiral shaft 10*b* within the borehole H. The amount of resin supplied will of course depend on the relative sizes of the spiral shaft 10*b* and the borehole H, but is preferably sufficient to cover about 12-18 inches of the shaft 10*b* adjacent the tail end 10*c* or otherwise away from the head end 10*a* (which, of course, still remains spaced from the opening O of the borehole H). However, the resin could possibly cover as little as 6-8 inches, or as much as 24 inches.

Once the resin fully sets or cures (which normally takes only seconds after mixing), a stationary, hardened resin "nut" 12 is thus formed around at least a portion of the spiral shaft 10*b* in the borehole H. Manufacturers of resin often provide information on the curing time, and it is preferable to wait until after such time to take any further action.

As should be appreciated, this resin nut 12 has an internal thread matching the spiral thread of the adjacent shaft 10*b* and occupied by it. In the case of the left-handed spiral, the bolt 10 may be rotated in a direction opposite the first direction (note action arrow L) and in the same direction as the spiral (but possibly instead in a direction that is the same as the first direction, both during mixing and tensioning). As a result of the substantially constant maximum width or consistent diameter at least partially surrounded by uncured resin, the engagement between the spiral shaft 10*b* and the resin nut 12 causes the bolt 10 to advance within the borehole H when so rotated, thus moving the head end 10*a* closer to the adjacent opening O. However, the hardened resin nut 12 remains stationary due to the peripheral contact with the sidewall of the borehole H.

This rotation may be completed until any associated engagement hardware, such as a plate P, is brought into_secure engagement with the face F (which normally will take less than one complete turn). The appropriate amount of torque is then applied to ensure that the bolt 10 is fully tensioned and the strata compressed or anchored in the desired manner. As noted above, the depth D of the borehole H is made at least slightly greater than the overall length B of the bolt 10 such that the tail end 10*c* can freely advance and does not "bottom out" during the final advance caused by tensioning.

Numerous advantages may thus arise from the use of the above-described technique. First of all, the bolt 10 in the preferred embodiment may be made of only one piece of material, and need not include any expansion shells or external nuts in order to be effective. Accordingly, no parts require assembly "on-site." This not only substantially reduces the manufacturing cost, but also facilitates ease of installation and results in a stronger bolt.

Additionally, only partial grouting of the borehole is required for effectively practicing the present invention. Thus, substantially less grout is required, as compared to arrangements in which the borehole is fully grouted. A concomitant savings in material cost invariably results (possibly as much as 75%), as well as a reduction in the cost of transporting the grout into the mine and maintaining it in a "ready for use" state.

Figure 4:
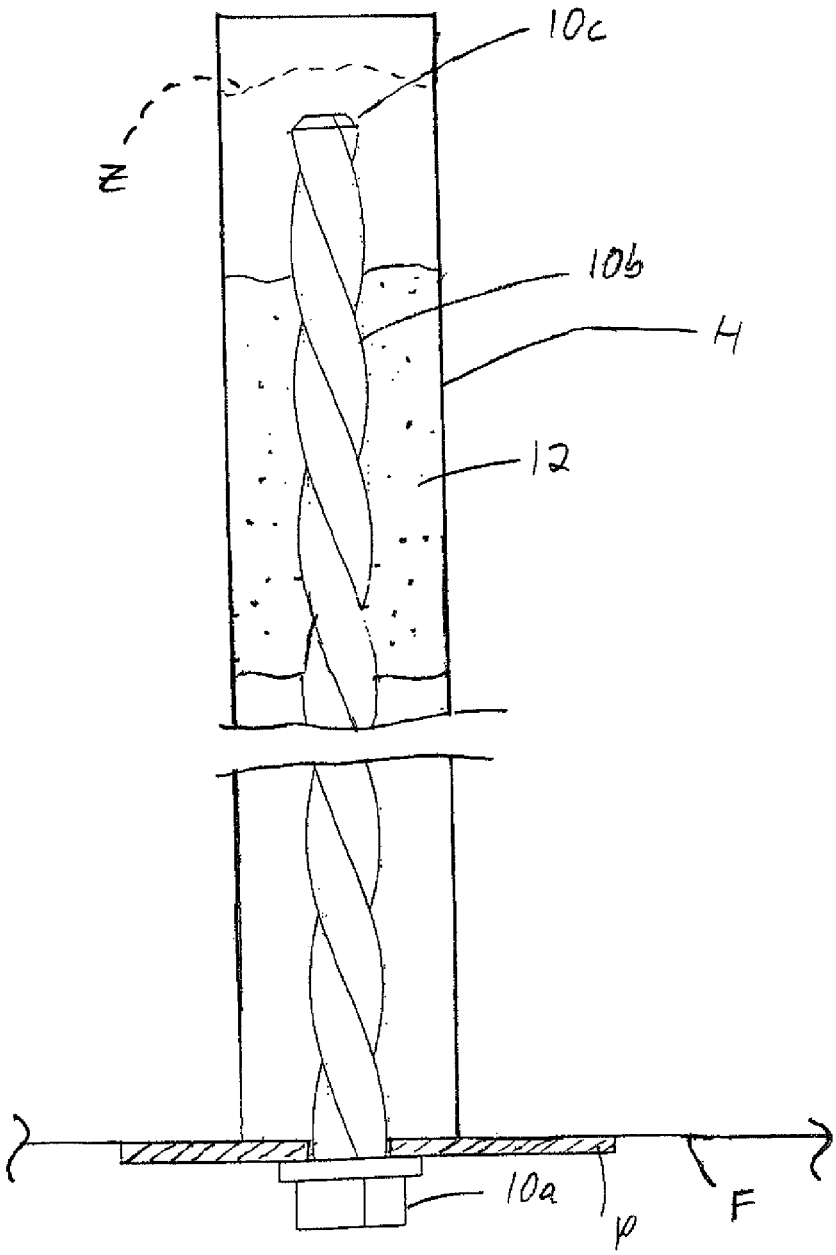

The completed installation of the bolt 10 also advantageously results in the head end 10*a* being positioned extremely close to face F of the mine roof (see FIG. 4). Thus, unlike prior arrangements in which an external nut is threaded onto an exposed shank projecting several inches from the face F, there is very little depending structure of the installed bolt 10 to engage a passing machine or person. This is especially important in narrow mine passages resulting from a low seam height. Moreover, since essentially the entire shaft 10*b* of the bolt 10 is drawn into the borehole H, the overall appearance of the face F is more regular and aesthetically pleasing.

Finally, aside from being one piece, the bolt 10 can be manufactured in a relatively easy and inexpensive manner. Square or round bar stock of any suitable width dimension (e.g., ½", ⅝", or ¾" for a 1" borehole) can simply be worked to the desired pitch (whether considered twists per linear unit, or thread-to-thread spacing) to form the shaft 10*b*. The head end 10*a* is typically forged. Conveniently, the spiral can also be formed on a relatively long piece of stock, which can then be cut into lengths corresponding to the shaft 10*b* of the bolt 10.

Figure 6:
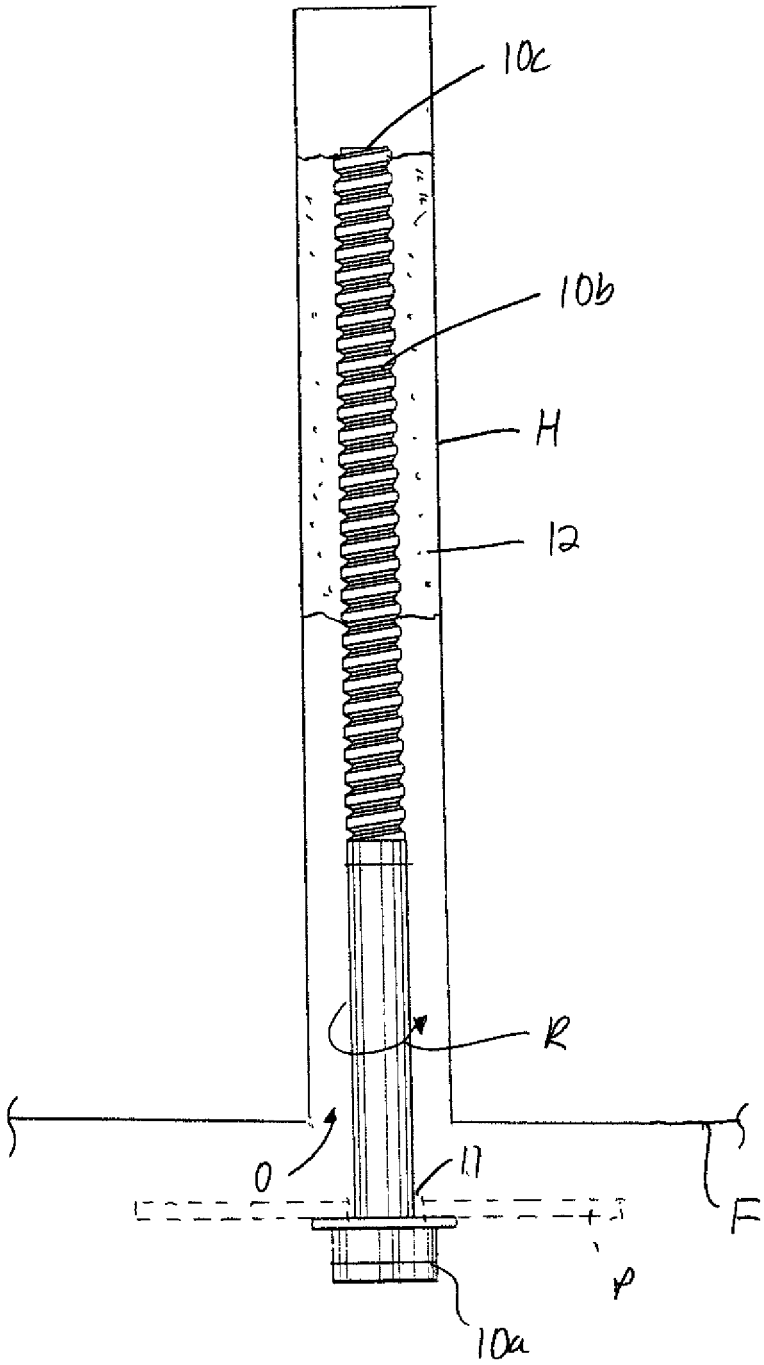
FIGS. 6-7 are schematic diagrams showing the manner in which the spiral bolt of FIG. 5 may be tensioned using a resin nut formed in the borehole.
Figure 7:
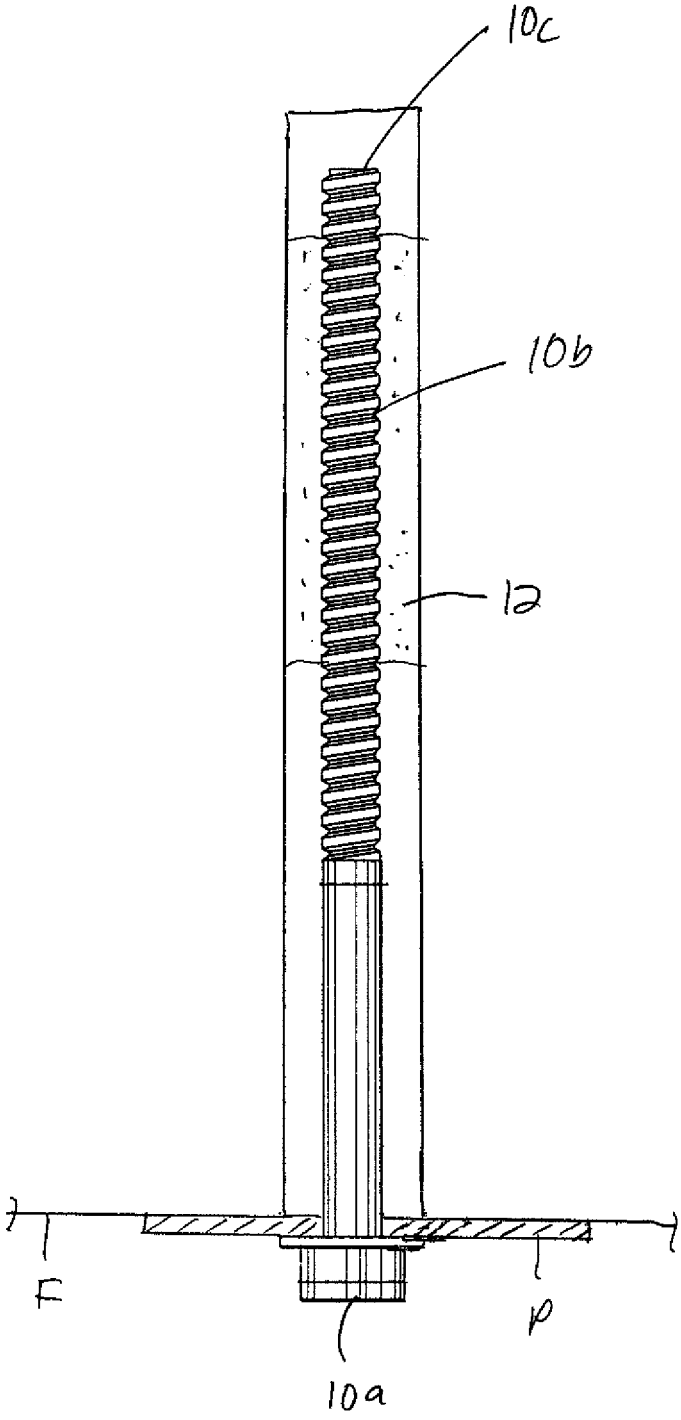

FIGS. 6-7 illustrate a similar installation method with the bolt 10 of FIG. 5.

During manufacturing, the working applied to the bar (which is typically made of steel) may result in the elimination of the exterior surface oxide layer, or "scale," created during the hot roll process. The absence of the scale allows faster oxidation of the bar, especially when the bolt 10 is stored outdoors and exposed to the elements during the period between manufacturing and ultimate use in the mine. Any deterioration of the surface may inhibit the ability of the shaft 10*b* to turn freely within the resin nut 12 during installation.

To ameliorate any such problem, it is possible to coat at least part of the spiral shaft 10*b* (such as the uppermost portion) after manufacture with either a lubricity agent or a rust-inhibiting agent, or both. The partial or full application of such agent(s) is anticipated to ease the installation by allowing the spiral shaft 10*b* to rotate more freely relative to the resin nut 12 during tensioning. Preferably, the lubricity agent comprises a blend of polymers and high-density silicones. One example of a product that has been found to work exceptionally well is distributed as a tire wetting agent sold under the name BLACK MAGIC Tire Wet by SOPUS Products of Houston, Tex.

A fixing agent may also be applied to help retain the lubricity agent. In the case where the BLACK MAGIC Tire Wet product serves as the lubricity agent, the mixture may comprise two parts paint (such as, for example, KRYLON QUICK DRY Alkyd Enamel) having a particular coloring to one part lubricity agent. Providing any coating with a coloring (e.g., a yellow or green pigment) is also contemplated. As a result, the installer may not only ensure that the coating remains present on an appropriate portion of the shaft 10*b*, but also can readily differentiate the spiral bolts 10 for use in the present method from others.

The particular lubricity agent mixed with a fixing agent, such as paint, is advantageous in that it dries or hardens to coat the spiral portion shortly after being applied to the bolt 10. Thus, unlike oil-based coatings that are sprayed on and would provide the desired lubricity, but remain in a "wet" condition and do not dry, this dried coating is most preferred, since it will not intermix with the resin upon encountering it in the borehole. This ensures that the coating remains present on the spiral portion and effective for providing the desired lubricity with the resin nut once the resin is completely hardened.

A particularly significant advantage of the coating is that it thus remains present on the bolt 10 after installation. This facilitates the essentially effortless rotation of the bolt 10 not only during installation, but also during later rotation, such as if the bolt is in need of retensioning or retorquing (such as in the event there is a shift in the strata or other condition that changes such that the tension originally supplied becomes inadequate over time). Accordingly, tension can be re-applied weeks, months, or even years after the initial installation. This is a significant advantage, especially if the plate P is inadvertently hit, there is subsequent shrinkage or shifting in the strata, or some of the roof immediately breaks away. Indeed, if necessary or desired, the bolt 10 can be completely unthreaded from the borehole and reinstalled in the existing resin nut 12.

During installation, it may also sometimes result that the resin cures not only along a portion of the spiral shaft 10*b*, but also within the portion of the borehole H into which the bolt 10 must advance during tensioning (see dashed line Z in FIG. 4). Although this does not preclude installation, it may be helpful to make the tail end of the bolt 10 with a point or taper, as shown. This will help it advance within the resin nut 12, if such is necessary.

Although the pitch of the spiral may be varied, it is also desirable to ensure that the spiral bolts 10 for use in a common installation are consistent. This keeps the installation torque required consistent. Likewise, the spiral shaft 10*b* should also be consistent to facilitate its movement through the resin nut 12 once formed. The pitch of the spiral is also preferably such that there is noticeable movement of the head end 10*a* toward the opening O of the borehole H during installation, thus giving the installer a visual cue that the process is proceeding as expected.

The use of conventional types of washers, such as those made of, or coated, with TEFLON or other anti-friction types, is also possible between the head end 10*a* (or flange 11) and any associated structure (such as plate P). However, it is believed that the use of such anti-friction washers is less important with this type of arrangement than with conventionally threaded bolts, since conventionally threaded bolts require many revolutions for installation, resulting in greater friction and heat, and less effective tension/torque ratios.

Various torque/tension ratios achieved during tests involving one embodiment of the disclosed spiral bolt in combination with a resin nut are illustrated in the following table. Spin and hold times for the 10 second MINOVA resin were as shown. The pull rests indicate that a 2 foot grouted resin length is not susceptible to deterioration in anchorage performance using either forward or reverse rotation.

| Roof Bolt Test | | | Bolt #1 | Bolt #2 | Bolt #3 | Bolt #4 | |
|---|---|---|---|---|---|---|---|
| Bolt Length: | 42" | Inst. Tq. | Est. 250 | Est. 250 | Est. 250 | Est. 250 | |
| Bolt Diameter:. | .680" | Pre-Pull Tq. | Est. 250 | Est. 250 | Est. 250 | Est. 250 | |
| Hole Diameter: | 1" | (Note: Gauge on bolter was showing 2,500 PSI on each installation) | | | | | |
| Steel Grade: | 55 | | | | | | |
| Resin Dia. & Lgh: | .9" × 2.0" | | | | | | |
| Resin Spin & Hold: | 3 Sec. & 10 Sec. | | Reverse | Reverse | Forward | Forward | AVE |
| Plate Code | F-8" × 8" × ⅜" × 1" | 3 Tons | 0.000 | 0.000 | 0.000 | 0.000 | 0.000 |
| | | 4 Tons | 0.007 | 0.009 | 0.006 | 0.004 | 0.007 |
| Other: | 2" HW, W/Collar | 5 Tons | 0.015 | 0.018 | 0.012 | 0.009 | 0.014 |
| | | 6 Tons | 0.025 | 0.029 | 0.023 | 0.021 | 0.025 |
| | | 7 Tons | 0.036 | 0.039 | 0.032 | 0.030 | 0.034 |
| | | 8 Tons | 0.051 | 0.052 | 0.047 | 0.045 | 0.049 |
| | | 9 Tons | 0.062 | 0.072 | 0.063 | 0.059 | 0.064 |
| | | 10 Tons | 0.079 | 0.090 | 0.086 | 0.079 | 0.084 |
| | | 11 Tons | 0.099 | 0.107 | 0.109 | 0.106 | 0.105 |
| | | 12 Tons | 0.127 | 0.130 | 0.136 | 0.130 | 0.131* |
| | | 13 Tons | Steel Yield | Steel Yield | Steel Yield | Steel Yield | Steel Yield |
| | | 14 Tons | | | | | |

(*Deflections in inches)

The foregoing description of various embodiments has been presented for purposes of illustration and description. It is not intended to be exhaustive or to limit the invention to the precise form disclosed. Obvious modifications or variations are possible in light of the above teachings. The present embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention. The disclosure of U.S. Pat. No. 7,481,603 is incorporated herein by reference.

The invention claimed is:

1. An apparatus for installation in a borehole formed in a face of a mine passage, comprising:

an elongated bolt including a spiral portion for positioning in the borehole, said spiral portion at least partially coated with a lubricity agent and a fixing agent; and a hardened resin nut with an internal thread along the entire length of the resin nut.

2. The apparatus of claim 1, wherein the hardened resin nut surrounds at least part of the spiral portion of the bolt and contacts the lubricity agent, whereby rotation of the spiral portion within the resin nut serves to move the bolt.

3. The apparatus of claim 1, wherein the lubricity agent is mixed with the fixing agent to fix the lubricity agent relative to the spiral portion of the bolt.

4. The apparatus of claim 3, wherein the ratio of the fixing agent to the lubricity agent is about 2:1.

5. The apparatus of claim 1, wherein the spiral portion comprises a threaded portion.

6. The apparatus of claim 1, wherein the bolt is substantially square in cross-section.

7. The apparatus of claim 1, wherein the bolt is substantially round in cross-section and comprises a steel bar.

8. The apparatus of claim 1, wherein the spiral portion includes a generally circular cross-section with approximately 4-5 threads per inch in the longitudinal direction.

9. The apparatus of claim 1, wherein the hardened resin nut extends only along the spiral portion of the bolt.

10. The apparatus of claim 1, wherein the hardened resin nut surrounds at least a first part of the spiral portion of the bolt while leaving a second part of the spiral portion of the bolt exposed.

11. A method of preparing a bolt including a spiral portion and a borehole formed in a face of a mine passage for insertion of the bolt therein, comprising:

providing a lubricity agent and a fixing agent on at least part of the spiral portion of the bolt.

12. The method of claim 11, further including the step of:

forming a stationary, hardened resin nut adjacent at least the spiral portion of the bolt; and rotating the spiral portion relative to the resin nut.

13. The method of claim 12, wherein the forming step comprises:

providing uncured resin within the borehole adjacent the spiral portion of the bolt;

rotating the bolt in a first direction to substantially maintain the resin adjacent the spiral portion; and allowing the resin to substantially cure and form the hardened resin nut.

14. The method of claim 13, wherein the step of rotating the bolt comprises rotating the spiral portion in a second direction opposite the first direction upon the substantial curing of the resin.

15. The method of claim 13, further including providing a fixing agent on at least part of the spiral portion of the bolt.

16. The method of claim 11, wherein the providing step includes substantially coating the entirety of the spiral portion of the bolt with the lubricity agent.

17. The method of claim 11, further including the step of mixing the lubricity agent and the fixing agent.

18. A method of installing an elongated bolt comprising a steel bar having a head end and a threaded or spiral portion in a face of a mine passage having a borehole, comprising:

inserting the bolt and a lubricity agent on the threaded or spiral shaft portion at least partially within the borehole;

rotating the bolt in a first direction and at least partially within an uncured resin in the borehole;

allowing the resin to substantially cure and form a nut; and rotating the bolt such that the bolt moves through the resin nut with the head end moving closer to the opening of the borehole.

19. The method of claim 18, wherein the head end of the bolt is initially spaced from the open end of the borehole, and the step of rotating the bolt advances the head end of the bolt toward the open end of the borehole.

20. The method of claim 18, wherein the step of rotating the bolt such that the bolt moves through the resin nut with the head end moving closer to the opening of the borehole comprises rotating the bolt in a second direction opposite the first direction.

21. The method of claim 19, wherein the step rotating the bolt such that the bolt moves through the resin nut with the head end moving closer to the opening of the borehole comprises rotating the bolt in the first direction.

22. The method of claim 18, further including providing a fixing agent on at least part of the spiral portion of the bolt.

23. An apparatus for installation in a borehole formed in a face of a mine passage, comprising:

an elongated bolt including a spiral portion for positioning in the borehole, said spiral portion at least partially coated with a lubricity agent fixed to the bolt; and a resin nut formed in the borehole and contacting at least part of the spiral portion of the bolt including the lubricity agent, said resin nut including an internal thread along the entire length of the resin nut.

24. In a device for insertion into a borehole formed in a face of a passage of a mine, wherein the device comprises an elongated bolt including a spiral portion, the improvement comprising the spiral portion being at least partially coated with a lubricity agent and a fixing agent.

25. The device of claim 24, further including a hardened resin nut including an internal thread along the entire length of the resin nut.

26. The device of claim 25, wherein the hardened resin nut extends only along the spiral portion of the bolt.

27. The device of claim 25, wherein the hardened resin nut surrounds at least a first part of the spiral portion of the bolt while leaving a second part of the spiral portion of the bolt exposed.

* * * * *

UNITED STATES PATENT AND TRADEMARK OFFICE

CERTIFICATE OF CORRECTION

PATENT NO. : 8,807,877 B1
APPLICATION NO. : 12/563542
DATED : August 19, 2014
INVENTOR(S) : Fox It is certified that error appears in the above-identified patent and that said Letters Patent is hereby corrected as shown below:

In the Claims

Column 9, claim 21, line 19, replace "claim 19" with --claim 18--.

Signed and Sealed this
Sixteenth Day of June, 2015

Michelle K. Lee

Michelle K. Lee
*Director of the United States Patent and Trademark Office*